US012521621B2

(12) United States Patent
Eder

(10) Patent No.: US 12,521,621 B2
(45) Date of Patent: Jan. 13, 2026

(54) BOWLING BOARD GAME

(71) Applicant: Scarb Enterprises, LLC, Lithia, FL (US)

(72) Inventor: Scott Eder, Lithia, FL (US)

(73) Assignee: Scarb Enterprises, LLC, Lithia, FL (US)

( * ) Notice: Subject to any disclaimer, the term of this patent is extended or adjusted under 35 U.S.C. 154(b) by 633 days.

(21) Appl. No.: 17/963,658

(22) Filed: Oct. 11, 2022

(65) Prior Publication Data

US 2023/0116661 A1 Apr. 13, 2023

Related U.S. Application Data

(60) Provisional application No. 63/254,615, filed on Oct. 12, 2021.

(51) Int. Cl.

| | |
|---|---|
| ***A63F 3/00*** | (2006.01) |
| ***A63F 1/04*** | (2006.01) |
| ***A63F 9/04*** | (2006.01) |

(52) U.S. Cl.

CPC ..... *A63F 3/00059* (2013.01); *A63F 1/04* (2013.01); *A63F 3/00697* (2013.01); *A63F 9/04* (2013.01); *A63F 2001/0475* (2013.01); *A63F 2003/00703* (2013.01)

(58) Field of Classification Search

None

See application file for complete search history.

(56) References Cited

U.S. PATENT DOCUMENTS

| | | | | | |
|---|---|---|---|---|---|
| 5,342,059 | A * | 8/1994 | Briem | A63F 3/00059 | 273/277 |
| 5,577,971 | A * | 11/1996 | File | A63D 1/00 | 473/54 |
| 5,899,815 | A * | 5/1999 | Helou | G07F 17/32 | 473/54 |
| 6,017,278 | A * | 1/2000 | Benko | A63D 5/04 | 473/64 |
| 2002/0010032 | A1 * | 1/2002 | Stiteler | A63D 5/04 | 463/40 |

* cited by examiner

*Primary Examiner* — Jason T Yen

(74) *Attorney, Agent, or Firm* — Weisberg I.P. Law, P.A.

(57) ABSTRACT

The present disclosure relates to a game played in connection to a player's bowling performance. The game includes a playing surface including a start, a finish, and a path extending between the start and finish. The game includes the path including a plurality of spaces. The game includes at least one gameplay instance associated with each of the plurality of spaces; and the gameplay instance has an outcome determined at least in part by the player's bowling performance.

14 Claims, 8 Drawing Sheets

BOWLING BOARD GAME

CROSS REFERENCE TO RELATED APPLICATIONS

This application claims priority to U.S. Provisional Application No. 63/254,615, filed Oct. 12, 2021, entitled "BOWLING BOARD GAME" the entirety of which is incorporated herein by reference.

FIELD

The present disclosure relates to the field of board games, and, more specifically, to a board game played in conjunction with the sport of bowling.

BACKGROUND

Bowling is a time-honored sport enjoyed by people worldwide. Tens of millions of people bowl for leisure and/or as a competitive sport in a given year in the United States alone, of which millions compete in certified league play. With so many participants, it is to be expected that many will seek out ways to improve their performance.

Meanwhile, board games have seen a significant increase in popularity in recent years. There has been a rise in the number of games as well as the number of people playing them. Some cities have seen cafes dedicated to board games, and Gen Con, a tabletop game convention, attracts over 70,000 attendees annually. The board game industry has seen growth between 25% and 40% annually, with some calling the current time a "golden era for board games."

SUMMARY

What is needed in the art is something that taps into the popularity, entertainment, and competitive nature of board games in a way that promotes improving one's bowling skill.

The present disclosure provides a bowling board game playable by one or more persons. Players may be at any skill level or age group to play the board game, and a player of any skill level has the potential to win the game. The game encourages players to focus on the objectives of the game rather than a particular bowling score. The game's objectives are designed to include encouraging practice of skills necessary to improve one's bowling prowess without the tedium many would associate with repetitive practice.

The game as described herein has a fantasy adventure theme. However, it should be appreciated that the mechanics of the game can be applied in any number of other themes, including but not limited to science fiction, racing, mystery, music career, history, animal, or military. Further, the theme of the game may be adapted for younger audiences by couching the tasks described herein as befriending creatures rather than defeating them, with the ultimate goal to be achieved in winning the game being a rescue mission.

In one aspect, the present disclosure includes a playing surface. The playing surface may be a physical playing surface, or, as described herein, it may be a virtual playing surface presented on an electronic device.

In another aspect, the playing surface includes a starting space, at least one encounter space, at least one challenge space, and at least one conclusion space. A start/finish path begins adjacent the starting space, passes through the encounter and challenge spaces, and terminates adjacent the conclusion space (or dragon space, in the case of embodiments using a fantasy theme).

In one aspect, the present disclosure provides a game played in connection to a player's bowling performance, the game comprising: a playing surface including a start, a finish, and a path extending between the start and finish; the path including a plurality of spaces; at least one gameplay instance associated with each of the plurality of spaces; and the gameplay instance having an outcome determined at least in part by the player's bowling performance.

In another aspect, one of a plurality of hero characters is assigned to the player, and the hero character has an associated hero ability that affects the gameplay instance.

In another aspect, the further comprises a token placed on the path, the token being moved along the path according to the outcome of the gameplay instance.

In another aspect, the game further comprises a plurality of cards each including at least one image indicating a requirement of the player's bowling performance, the outcome of the gameplay instance being determined by whether the player's bowling performance meets the requirement.

In another aspect, the player is assigned a bowling skill level, and the outcome of the gameplay instance corresponds to the player's skill level.

In another aspect, the game further comprises at least one die, wherein the requirement is determined at least in part by the result of a roll of the at least one die.

In another aspect, a subset of the plurality of cards are encounter cards, and each encounter card includes an indication of a number of faces of the at least one die.

In another aspect, a subset of the plurality of cards are victory cards, and each victory card includes an indication of a victory requirement, the player's bowling performance meeting the victory requirement resulting in the player winning the game.

In another aspect the at least one gameplay instance corresponds to a predetermined challenge, and completion of the challenge includes at least one of knocking over a predetermined number of pins, bowling a spare, and bowling a strike.

In another aspect, the at least one gameplay instance corresponds to a predetermined challenge, and completion of the challenge includes knocking over designated bowling pins without knocking over non-designated bowling pins.

In another aspect, one of a plurality of hero characters is assigned to the player, and the hero character has an associated hero ability that affects the gameplay instance.

In another aspect, the further comprises a token placed on the path, the token being moved along the path according to the outcome of the gameplay instance.

In another aspect, the game further comprises a plurality of cards each including at least one image indicating a requirement of the player's bowling performance, the outcome of the gameplay instance being determined by whether the player's bowling performance meets the requirement.

In another aspect, the player is assigned a bowling skill level, and the outcome of the gameplay instance corresponds to the player's skill level.

In another aspect, the game further comprises at least one die, wherein the requirement is determined at least in part by the result of a roll of the at least one die.

In another aspect, a subset of the plurality of cards are encounter cards, and each encounter card includes an indication of a number of faces of the at least one die.

In another aspect, a subset of the plurality of cards are victory cards, and each victory card includes an indication of a victory requirement, the player's bowling performance meeting the victory requirement resulting in the player winning the game.

In another aspect the at least one gameplay instance corresponds to a predetermined challenge, and completion of the challenge includes at least one of knocking over a predetermined number of pins, bowling a spare, and bowling a strike.

In another aspect, the at least one gameplay instance corresponds to a predetermined challenge, and completion of the challenge includes knocking over designated bowling pins without knocking over non-designated bowling pins.

These and other objects, features and advantages of the present disclosure will become clearer when the drawings as well as the detailed description are taken into consideration.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components. The exemplifications set out herein illustrate embodiments of the present disclosure and such exemplifications are not to be construed as limiting the scope of the present disclosure in any manner.

DETAILED DESCRIPTION

Figure 1:
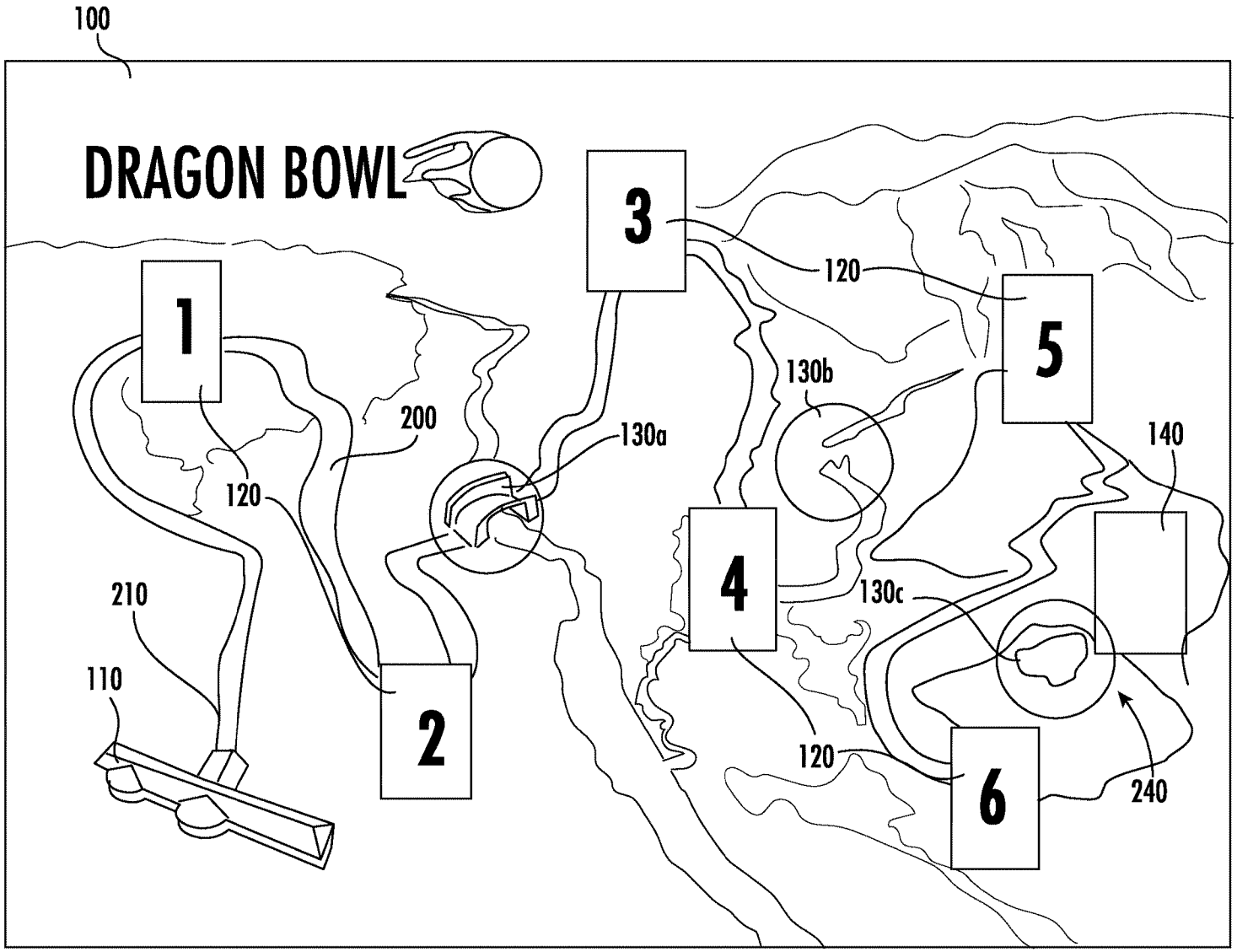
FIG. 1 is a schematic representation of a playing surface according to an embodiment of the present disclosure.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the present disclosure.

In the following description, for the purposes of explanation, numerous specific details are set forth in order to provide a thorough understanding of the described embodiments. It will be apparent to one skilled in the art however, that other embodiments of the present disclosure may be practiced without some of these specific details. Several embodiments are described herein, and while various features are ascribed to different embodiments, it should be appreciated that the features described with respect to one embodiment may be incorporated with other embodiments as well. By the same token however, no single feature or features of any described embodiment should be considered essential to every embodiment of the present disclosure, as other embodiments of the present disclosure may omit such features.

In this application the use of the singular includes the plural unless specifically stated otherwise and use of the terms "and" and "or" is equivalent to "and/or," also referred to as "nonexclusive or" unless otherwise indicated. Moreover, the use of the term "including," as well as other forms, such as "includes" and "included," should be considered non-exclusive. Also, terms such as "element" or "component" encompass both elements and components including one unit and elements and components that include more than one unit, unless specifically stated otherwise.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

In one or more examples, the described techniques may be implemented in hardware, software, firmware, or any combination thereof. If implemented in software, the functions may be stored as one or more instructions or code on a computer-readable medium and executed by a hardware-based processing unit. Computer-readable media may include non-transitory computer-readable media, which corresponds to a tangible medium such as data storage media (e.g., RAM, ROM, EEPROM, flash memory, or any other medium that can be used to store desired program code in the form of instructions or data structures and that can be accessed by a computer).

Instructions may be executed by processing circuitry, for example in a computing device. Processing circuitry may be configured to control any of the methods and/or processes described herein and/or to cause such methods, and/or processes to be performed, e.g., by the computing device. Processing circuitry may include one or more processors for performing computing device functions described herein. The computing device includes memory that is configured to store data, programmatic software code and/or other information described herein. In some embodiments, software and/or a host application may include instructions that, when executed by the processor and/or processing circuitry, causes the processor and/or processing circuitry to perform the processes described herein with respect to computing device. The instructions may be software associated with the computing device.

Processors and/or processing circuitry may include one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor" as used herein may refer to any of the foregoing structure or any other physical structure suitable for implementation of the described techniques. Also, the techniques could be fully implemented in one or more circuits or logic elements.

As this present disclosure is susceptible to embodiments of many different forms, it is intended that the present disclosure be considered as an example of the principles of the present disclosure and not intended to limit the present disclosure to the specific embodiments shown and described.

As used herein, gutter, boards, bowling ball, pin, strike, spare, and frame are given their ordinary meaning in accordance with the customary rules of ten-pin bowling, to the extent that such meaning is consistent with the description provided herein. More specifically, "strike" means to knock down all ten pins on the first throw of a two-throw frame. A spare means to hit fewer than ten pins on the first throw in the frame, but to conclude the two-throw frame having knocked over all ten pins. "Ball" and "bowling ball" are used interchangeably. "Pin" and "bowling pin" are used interchangeably. The terms "hit," "knock down," and "knock over" a pin are used interchangeably and mean the pin comes to rest other than in a standing, vertical orientation following a bowling throw.

Variants to the rules are presented herein and are associated with embodiments of a "party" edition according to the present disclosure. The "party" edition has simplified gameplay mechanics, allowing it to be played in less time or by players who are looking for streamlined rule mechanics.

The present disclosure is generally related to a board game for one or more players wherein a player's progression is associated with that player's performance while bowling standard bowling frames. The difficulty of challenges the game presents are adjusted according to the respective players' skill level at the game of bowling, enabling players of varying skill levels to compete on equal footing. The game encourages players to focus on the objectives of the game rather than a particular bowling score. The game's objectives are designed to encourage practice of skills necessary to improve one's bowling prowess without the tedium many would associate with repetitive practice.

An embodiment of the present disclosure is playable by between one and six players or teams, inclusively. When the game is played by one or more teams, it is preferred that the composition of each team be players of similar bowling skill levels. A player's skill level, which in one embodiment is determined based on bowling handicap, determines in part the objectives that must be met in a game session. Prior to commencement of a game session, each player or team is assigned to one of a plurality of pre-determined skill categories.

Each player or team then selects from a set of available tokens. In the case of the fantasy adventure theme described herein, each token represents a hero character. Each hero character has a unique mechanic that can be employed during the game session.

In at least one embodiment, the game session begins with each player or team placing the chosen tokens on the starting space. Each player or team must then complete an initial objective, the difficulty level of which is determined by the player or team's respective skill level. In the case of team play, in at least one embodiment all members of a team must complete the initial objective. Players or teams take turns attempting to complete the objectives. A player's turn is measured by a standard bowling frame. The player attempts to meet an objective during that frame.

Upon completing the initial objective, a player's token moves forward to the next space, which is either an encounter space, challenge space, or dragon space. Each space type has a respective type of task that the player must complete to progress. Encounter spaces are associated with encounter cards. An encounter card has a strength value printed on it that, in conjunction with the player's skill level, determines the difficulty and method of overcoming the encounter.

Challenge spaces are pre-determined according to the rules of the game. The difficulty level of a challenge is determined by the player's skill level.

The final space on the board is the victory space, which, in at least one embodiment, may be a dragon space. The dragon space is associated with a victory card, which in at least one embodiment may be a dragon card. A dragon card describes what a player must do for three consecutive frames to successfully complete the task. Each of those frames are required to be a spare or strike. Each dragon card has a unique series of requirements for the three frames. For example, a first dragon card may require that a player bowl a strike in the first frame, a strike in the second frame, and a spare in the third frame, while a second dragon card may require that the bowler bowl a strike in the first frame, a spare in the second frame, and a strike in the third frame. The meaning of "strike" and "spare" for purposes of interpreting the dragon card's task is adjusted in accordance with a player's skill level.

The first player to complete the task according to the dragon card wins the game. If multiple players complete this task in the same bowling frame, a tie-breaker occurs.

As described in further detail below, alternate embodiments of the present disclosure may use an electronic representation of the playing surface.

In at least one embodiment, team play is permitted. In the case of team play, multiple players of equally categorized skill form a team and complete objectives together. In the case of embodiments using team play and unless otherwise specified, as used herein the terms "team" and "player" are interchangeable.

In a non-limiting example, a player's bowling skill may be categorized according to the player's bowling average:

1. Beginner: 100 or less
2. Intermediate: 100-149
3. Advanced: 150-199
4. Expert: 200-224
5. Pro: 225+

A player's average can be calculated by dividing the total number of pins credited to the bowler in a league by the number of games bowled in that league. Alternatively, more casual bowlers may choose a difficulty level based on what they have bowled in the past. Newer bowlers who have difficulty keeping the ball on the lane are encouraged to start at the beginner level.

However, other embodiments may use other ranges of averages, a different number of difficulty levels, or may use another method of assessing player skill. As a non-limiting example, players may be categorized as either beginning bowlers who require the assistance of bowling lane bumpers, or intermediate players who do not.

The difficulty level of tasks a player must complete is correlative with the player's categorized skill level. Players are encouraged to "bowl up" by selecting a higher difficulty level for an increased challenge.

The game as described herein has a fantasy adventure theme. However, it should be appreciated that the mechanics of the game can be applied in any number of other themes, including but not limited to science fiction, racing, mystery, music career, history, animal, or military. Further, the theme of the game may be adapted for younger audiences by couching the tasks described herein as befriending creatures rather than defeating them, with the ultimate goal to be achieved in winning the game being a rescue mission.

FIG. 1 is a schematic representation of a playing surface 100. In at least one embodiment, the playing surface 100 is a physical game board. However, as further described herein, the playing surface 100 may be represented electronically as well.

A number of spaces, each corresponding to a gameplay instance, may be arranged on the playing surface 100. Examples of gameplay instances include a starting space 110, at least one encounter space 120, at least one challenge space 130*a-c*, and a final space 140. A start/finish path 200 is disposed on the playing surface 100. The start/finish path 200 has a starting end 210 adjacent the starting space 110 and a finish end 240 adjacent the final space 140. Encounter spaces 120 and challenge spaces 130*a-c* are arranged along the length of the start/finish path. Advancing a player's token along the start/finish path 200 means moving it from one space to the next adjacent space in a direction away from the starting end 210 and toward the finish end 240. Moving a player's token backwards means moving it from one space to the next adjacent space in a direction toward the starting end 210 and away from the finish end 240.

At the beginning of the game session, players may each choose a token, which represents the player's progress in the game. The token may be a three-dimensional figurine, disc, chip, pawn, standee, or any other suitable type of marker for indicating a respective player's position on the playing surface 100.

In at least one embodiment in which the present disclosure uses a fantasy theme, each token is also associated with a hero character that has a unique ability. The unique ability can be employed by the player during a game session.

For illustrative purposes, non-limiting examples of heroes can include:

1. Meganna Sparemore, a half-orc ranger who can bypass an encounter (other than a dragon or challenge) once per game session
2. Ro' Allay Dawnstrike, an elven war mage who can allow a player to re-roll a die twice per game session.
3. Baroden Pincrusher, a dwarf warrior who can add +1 to a player's pin count (e.g. turning a player's pin count of 6 into a 7) twice per game session.
4. Prince Corwin Waunabole aka "TripFour," a human rogue, who can steal another player's die roll. Once all players have rolled their respective dice, the player who has chosen Prince Corwin can exchange their die roll for that of another. In other words, if the player who has chosen Prince Corwin rolls a 9, and another player has rolled a 3, the two values are exchanged. This can be used twice per game session.
5. Arbiter Omara Stoneight, justice incarnate, who can copy the die roll from the player's prior frame and use it in the current frame, twice per game session.
6. Xan TenPin, a chronomancer, who can re-roll a bowling shot twice per game session. The re-rolled shot replaces the prior shot.

However, alternative or additional hero types may be used in various embodiments, including heroes modeled after professional bowlers. Additionally, in a "party" edition, the game mechanics may not provide for the use of hero abilities.

Figure 2:
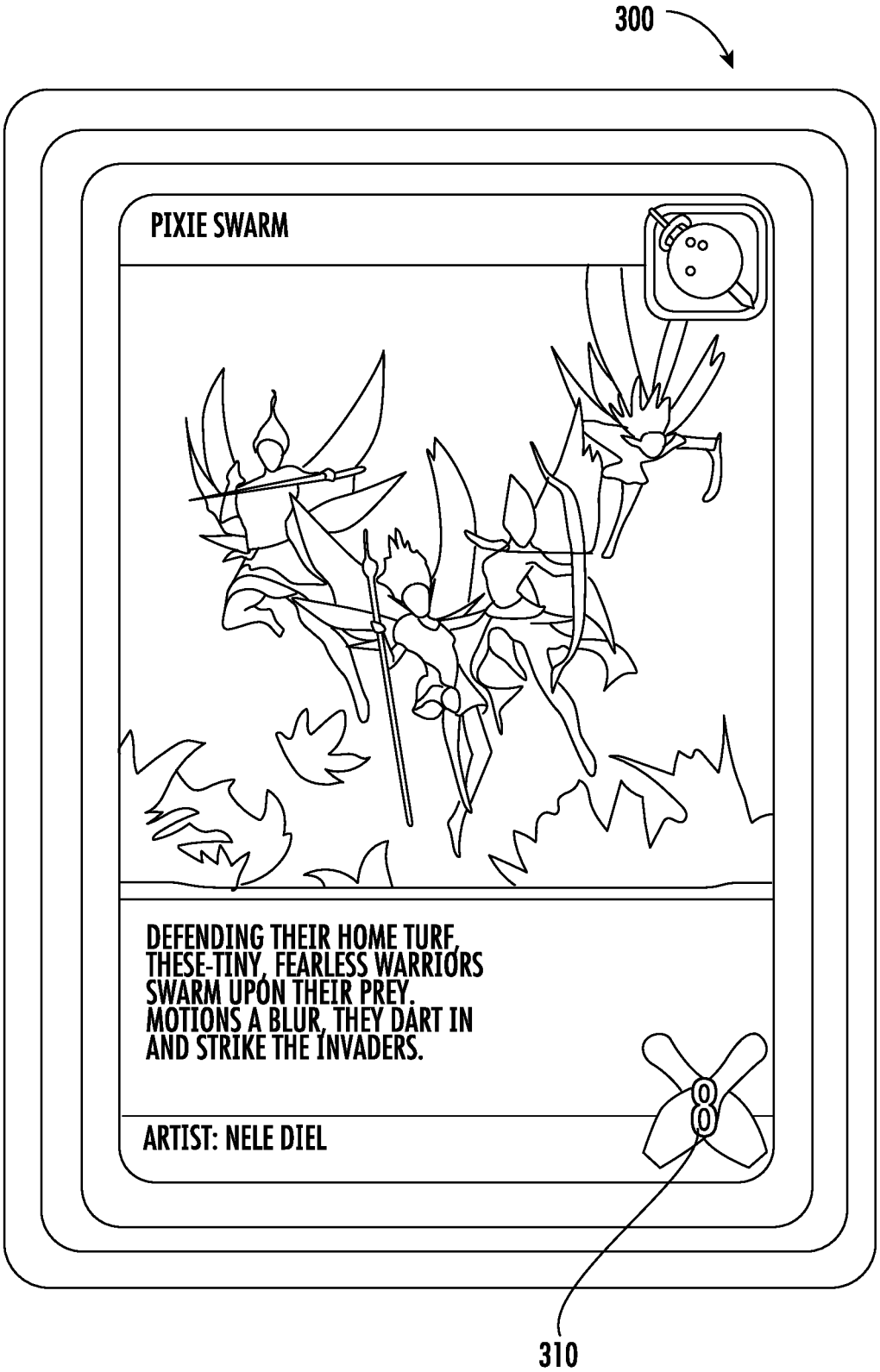
FIG. 2 is a schematic representation of an encounter card according to an embodiment of the present disclosure.
Figure 3:
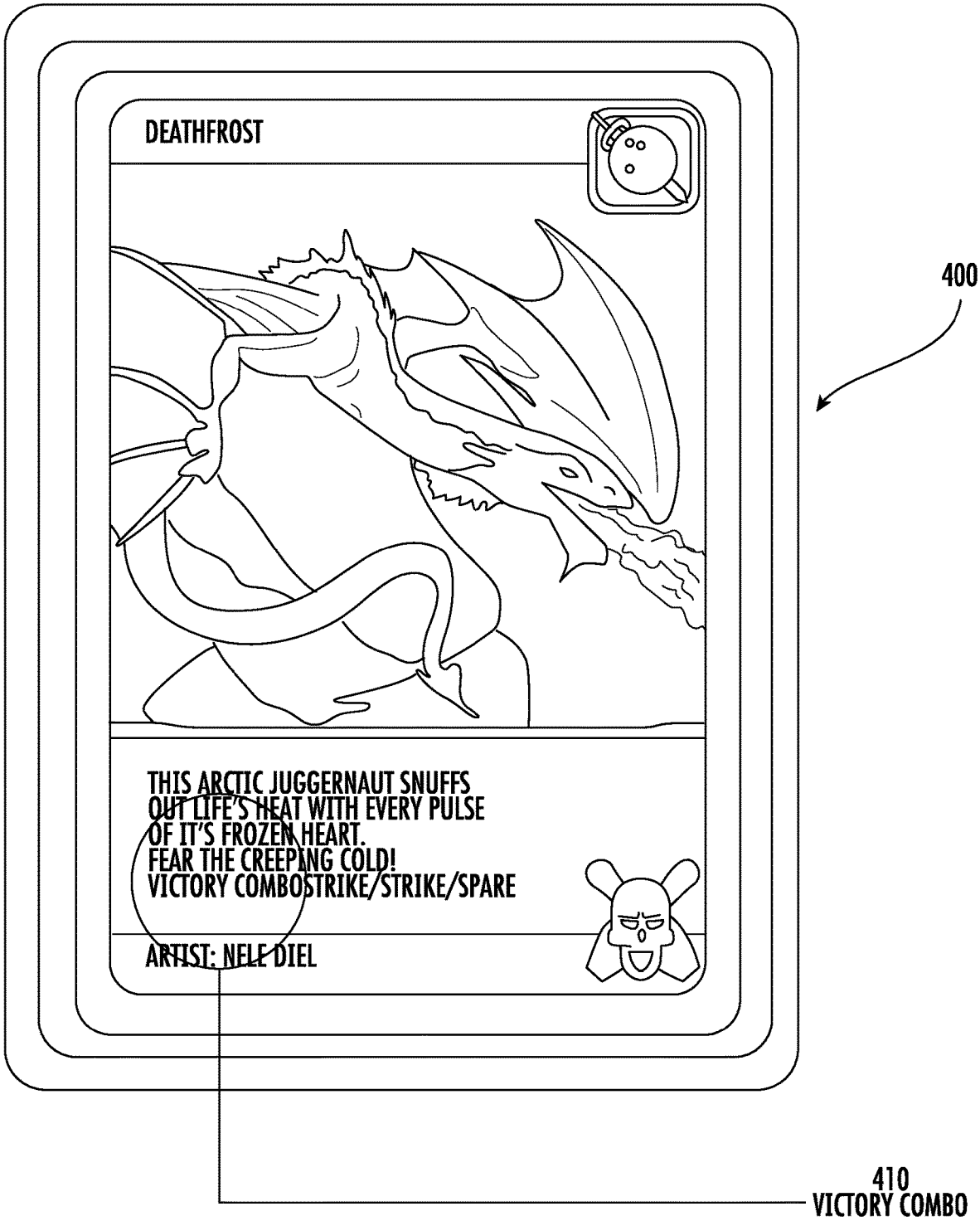
FIG. 3 is a schematic representation of a victory card according to an embodiment of the present disclosure.

With reference to FIGS. 2 and 3, the present disclosure further comprises a plurality of encounter cards 300 and dragon cards 400. In at least one embodiment, the present disclosure comprises 20 encounter cards 300 and five dragon cards 400 However, these numbers can vary in other embodiments. In the case of an exemplary "party" edition, eight encounter cards 300 and two dragon cards 400 are used.

An embodiment of the present disclosure additionally comprises at least one die. Other embodiments employ a plurality of dice, including each of a d4, d6, d8, d10, d12, and d20 die. An embodiment of a "party" edition may omit the dice.

With reference to FIGS. 1 through 3, to begin a typical playing session, players place their respective tokens on the starting space 110, also referred to as the "proving grounds" in a fantasy-themed embodiment. The encounter cards 300 and dragon cards 400 are shuffled. One encounter card 300 is placed face down on each of the numbered encounter spaces 120. A dragon card 400 is placed face down on the final space 140.

On a typical bowling lane, the boards are numbered sequentially from I to 39, left to right in the case of left-handed bowlers, or from right to left in the case of right-handed bowlers. Players attempting the "pro" or "expert" difficulty level must determine which of these boards is their initial board position. Additionally, bowlers attempting the "pro" difficulty level must number their bowling balls they will use for the game session, referred to herein as the player's "arsenal." During the course of a game according to at least one embodiment of the present disclosure, a player may be required to move from their initial board position to a new board position. However, a player's board position is reset to its initial position at the beginning of their following turn.

Game play is measured in standard, two-ball bowling frames. In each frame, a player attempts to successfully complete a task. Once a player has bowled a frame, play then passes to the next player. Once all players have bowled that frame, the next frame begins.

Play begins with each player attempting to successfully complete a task associated with the starting space 110 The difficulty of the task correlates with the player's skill level and chosen difficulty level. Examples of the starting task needed to be completed are:

1. Beginner: Bowl a strike, or else hit at least one pin with the first and second ball.
2. Intermediate: Strike, spare, or hit at least seven pins with the first ball, and at least one pin with the second ball.
3. Advanced: Strike or spare
4. Expert and Pro: Strike Any player who fails to complete the task leaves their token on the starting space 110 and attempts the task again on their next turn. Players who complete the task advance their token to the next space along the start/finish path 200 In the case of team play, all players on a team must complete the starting task for the team's token to advance. Players on a team who fail to successfully complete the starting task must try again on the team's next turn.

If a player begins their turn on an encounter space 120, the player must complete an encounter task. If the encounter card 300 is face-down, it is flipped so that it is face up. Each encounter card 300 has a strength rating 310 on its face. A player attempting to complete an encounter task must first roll a die whose number of faces matches the strength rating 310. This occurs even if the player attempted that challenge space 130 on a previous turn. For example, if the strength rating 310 is 6, the player will roll a d6; if the strength rating 310 is 8, the player will roll a d8. For beginner, intermediate, and advanced skill levels, if the strength rating 310 is greater than 10 and the resultant roll is greater than 10, the die roll is instead treated as if it were a 10. The specifics of the encounter task are dependent upon the player's die roll. A player has a standard two-roll bowling frame to attempt to complete the encounter task. If a player successfully completes the encounter task, their token is advanced to the next space along the start/finish path 200 If the player fails to complete the task successfully, their token may remain on the encounter space 120 or may be moved backwards one space along the start/finish path 200 in the direction of the starting end 210, depending on the player's performance. However, if the space immediately preceding the encounter space 120 is the starting space 110, the player's token cannot be moved backwards and instead would remain on the encounter space 120. Examples of encounter tasks according to player difficulty level are:

1. Beginner: Bowl a strike or else knock over a number of pins equal to or greater than the die roll to successfully complete the encounter task and advance to the next space along the start/finish path 200. If the number of pins knocked over at the end of the frame is less than the die roll, but any number of pins are knocked down on either of the two throws, the player remains on the encounter space 120. If the player's ball lands in the gutter on both throws, the player moves back one space along the start/finish path 200 in the direction of the starting end 210.
2. Intermediate: Player must bowl a strike or else knock over a number of pins equal to or greater than the die roll with the first ball to successfully complete the encounter task and advance to the next space along the start/finish path 200. If the player fails to hit the required number of pins on the first roll, but completes a spare with their second ball or hits at least one pin with their second ball, the player remains on the encounter space 120. Otherwise, the player moves back one space along the start/finish path 200 in the direction of the starting end 210.
3. Advanced: Player must bowl a strike, or else knock over a number of pins equal to or greater than the die roll with the first ball and then spare with the second ball to successfully complete the encounter task and advance to the next space along the start/finish path 200 If the player hits the required number of pins on the first ball but fails to spare with the second ball, the player remains on the encounter space 120. If the player knocks over a number of pins less than the die roll with their first ball, but completes a spare with their second ball, they remain on the encounter space 120. Otherwise, the player moves back one space along the start/finish path 200 in the direction of the starting end 210.
4. Expert: The player's initial board position is moved by a number of boards equal to the die throw. To determine the direction the player must move, a d4 is rolled. The board position moves to the right in the case of an even throw, or to the left in the case of an odd throw. The player then bowls from that new board position, except that if the new board position is less than 1, the new board position becomes the 1 board, or if the new board position is greater than 39, the new board position becomes the 39 board. The player must bowl a strike to successfully complete the encounter task and advance to the next space along the start/finish path 200. If the player fails to strike, but does bowl a spare, the player remains on the encounter space 120. Otherwise, the player moves back one space along the start/finish path 200 in the direction of the starting end 210.
5. Pro: The player's initial board position is moved by a number of boards equal to the die throw. To determine the direction the player must move, a d4 is rolled. The board position moves to the right in the case of an even throw, or to the left in the case of an odd throw. The player then bowls from that new board position, except that if the new board position is less than 1, the new board position becomes the 1 board, or if the new board position is greater than 39, the new board position becomes the 39 board. The player also rolls a die with a number of faces equivalent to the number of bowling balls in the player's arsenal, then attempts the encounter task with the bowling ball that corresponds to the result of the die roll. The player must bowl a strike to successfully complete the encounter task and advance to the next space along the start/finish path 200. If the player fails to strike, but does bowl a spare, the player remains on the encounter space 120. Otherwise, the player moves back one space along the start/finish path 200 in the direction of the starting end 210.

In at least one alternate embodiment with only two difficulty levels, the encounter tasks may be simplified as follows:

1. Beginner: Must bowl a strike or else knock over a number of pins equal to or greater than the strength rating 310 by the conclusion of the frame to successfully complete the encounter task and advance to the next space along the start/finish path 200. If the player knocks over pins on both throws, but their total is less than the strength rating 310, the player remains on the encounter space 120. Otherwise, the player moves back one space along the start/finish path 200 in the direction of the starting end 210. However, if the space immediately preceding the encounter space 120 is the starting space 110, the player's token cannot be moved backwards and instead would remain on the encounter space 120.
2. Intermediate: Player must bowl a strike or else knock over a number of pins equal to or greater than the strength rating 310 on the first throw of the frame to successfully complete the encounter task and advance to the next space along the start/finish path 200. If the player hits fewer than the required number of pins on the first throw, but bowls a spare or knocks over at least one pin on the second throw, they remain on the encounter space 120 Otherwise, the player moves back one space along the start/finish path 200 in the direction of the starting end 210.

If a player begins their turn on a challenge space 130*a-c*, the player must successfully complete a challenge task to advance their token along the start/finish path 200. If the player fails the challenge task, their token remains on the challenge space 130*a-c*.

The challenge task is predetermined by the rules, rather than reliant on the random nature of cards. However, various embodiments may use challenge cards in a manner consistent with the use of other card elements described herein. In at least one embodiment, the playing surface 100 comprises a plurality of challenge spaces 130*a-c*. In at least one embodiment featuring such a plurality, each challenge space 130*a-c* has a different challenge task associated with it. Examples of challenge tasks include:

1. A first challenge task is associated with the first challenge space 130*a*. In the case of team play, if the team comprises fewer than four bowlers, all team members must successfully complete the challenge in the same frame. If the team has four or more bowlers, at least three bowlers must successfully complete the challenge in the same frame. The challenge must be completed for two frames in a row:

a. Beginner: Must bowl a strike, or else knock over at least six pins (alternatively, five pins in the case of "party" edition) with the first throw, and at least one pin with the second.

b. Intermediate: Must bowl strike or knock over at least seven pins (alternatively, six pins in the case of "party" edition) with the first throw, and at least one pin with the second.

c. Advanced: Must bowl a strike or spare.

d. Expert/Pro: Must bowl a strike.

2. A second challenge task is associated with the second challenge space 130*b*. In the case of team play, the team uses the "Scotch doubles-style format" for alternating bowlers throwing within a frame. All the team members' turns must result in successfully completing the second challenge task in the case of teams with fewer than four members, or at least three team members' turns in the case of teams with four or more members. The challenge must be completed for two frames in a row:

a. Beginner: Must bowl a strike, or else knock over at least seven pins (alternatively, six pins in the case of "party" edition) with the first throw, and at least one pin with the second.

b. Intermediate: Must bowl a strike or knock over at least eight pins (alternatively, seven pins in the case of "party" edition) with the first throw, and at least one pin with the second.

c. Advanced/Expert/Pro: Must bowl a strike or spare.

3. A third challenge task is associated with the third challenge space 130*c*. In the case of team play, during a single frame, if one team member knocks down the requisite pins to one side during their turn, and another member of that team knocks down the requisite pins on the other side, the challenge during their turn is deemed completed. For all difficulty levels, the head pin must remain standing:

a. Beginner/intermediate: knock over any number of pins to one side of the head pin (i.e. the 1-pin) on the first throw, and knock over any number of pins on the opposite side of the head pin on the second throw, without the ball going in the gutter.

b. Advanced: Knock over no pins other than the 6- 9-, and 10-pin on the right side, and no pins other than the 4-, 7-, and 8-pin on the left side.

c. Expert/Pro: Knock over the 10-pin on the right side, and the 7-pin on the left side.

In at least one embodiment, if a bowler attempting the third challenge task is attempting to knock over pins to the left of the head pin and also inadvertently knocks over pins to the right, they fail the challenge and their turn concludes.

As an optional rule, players may agree that if any player or team fails to advance their token for three consecutive turns by failing to successfully complete an encounter or challenge task, the token may be advanced one space.

A player whose token advances to the final space 140 must successfully complete a final task. If the dragon card 400 on the final space 140 is face down, it should be flipped to reveal the card face. If the player fails the final task, the player's token remains on the final space 140 and the player attempts the final task again on their next turn.

Each dragon card 400 has a victory combination 410 printed thereupon. The victory combination 410 is a series of three goals, each of which reads either "strike" or "spare." Examples of victory conditions are "strike/strike/spare" or "spare/strike/spare."

A player beginning their turn on the final space 140 must attempt the final task. The difficulty of the task is adjusted according to a player's assigned difficulty level:

1. Beginner: a goal of "strike" is interpreted as knocking down at least seven pins on the first throw of a frame, and a goal of "spare" is interpreted as knocking over at least one pin with both throws in the frame.

2. Intermediate: a goal of "strike" is interpreted as knocking down at least eight pins on the first throw of a frame, and a goal of "spare" is interpreted as throwing a spare in the frame.

For each of Advanced, Expert, and Pro, a goal of "strike" is interpreted as throwing a strike, and a goal of "spare" is interpreted as throwing a spare in the frame. The final task at the expert and pro difficulty levels have the following additional requirements:

3. Expert: The player rolls a d4 to determine a direction (even corresponds to right, odd to left) and a d20 to determine a number of boards to move in that direction from their initial starting position, except that the player cannot move outside the 1 and 39 boards.

The player bowls from that new board position.

4. Pro: The player rolls a d4 to determine a direction (even corresponds to right, odd to left) and a d20 to determine a number of boards to move in that direction from their initial starting position, except that the player cannot move outside the 1 and 39 boards. The player also rolls a die with a number of faces equal to the number of bowling balls in the player's arsenal and selects the ball that matches the result of the roll. The player bowls from that new board position with the selected ball.

A player successfully completes the final task when they have completed each of the goals of the victory combination 410 in order and in sequential frames.

If only one player, or team in the case of a team competition, completes the final task in a frame, that player or team is the winner, and the game concludes.

If, however, multiple players, or teams in the case of team play, completes the final task in the same frame a tie-breaker commences. The game concludes for the players, or teams in the case of team play, who at the end of the frame have not successfully overcome the final challenge. The remaining competitors must complete a tie-breaker task according to their difficulty level:

1. Beginner: Bowl a strike or knock down at least seven pins (six pins in the case of a "party's" edition) with the first throw 2. Intermediate: Bowl a strike or knock down at least eight pins (seven pins in the case of a party's edition) with the first throw.

3. Advanced hero: Bowl a strike

4. Expert: The player rolls a d4 to determine a direction (even corresponds to right, odd to left) and a d20 to determine a number of boards to move in that direction from their initial starting position, except that the player cannot move outside the 1 and 39 boards. The player must then bowl a strike from that new board position.

5. Pro: The player rolls a d4 to determine a direction (even corresponds to right, odd to left) and a d20 to determine a number of boards to move in that direction from their initial starting position, except that the player cannot move outside the 1 and 39 boards. The player also rolls a die with a number of faces equal to the number of bowling balls in the player's arsenal and selects the ball that matches the result of the roll. The player bowls from that new board position with the selected ball and must bowl a strike.

If at least one player successfully completes the tie-breaker task in a frame, all remaining players who fail the tie-breaker task in that frame are eliminated. The non-eliminated players continue playing tie-breaker frames until only one player or team remains, who is deemed the winner.

Various embodiments of the present disclosure may use an electronic version of the components described herein. Accordingly, rather than being tangible items, the playing surface 100, cards 300, 400, tokens, and dice may be represented on a computing device.

Figure 4:
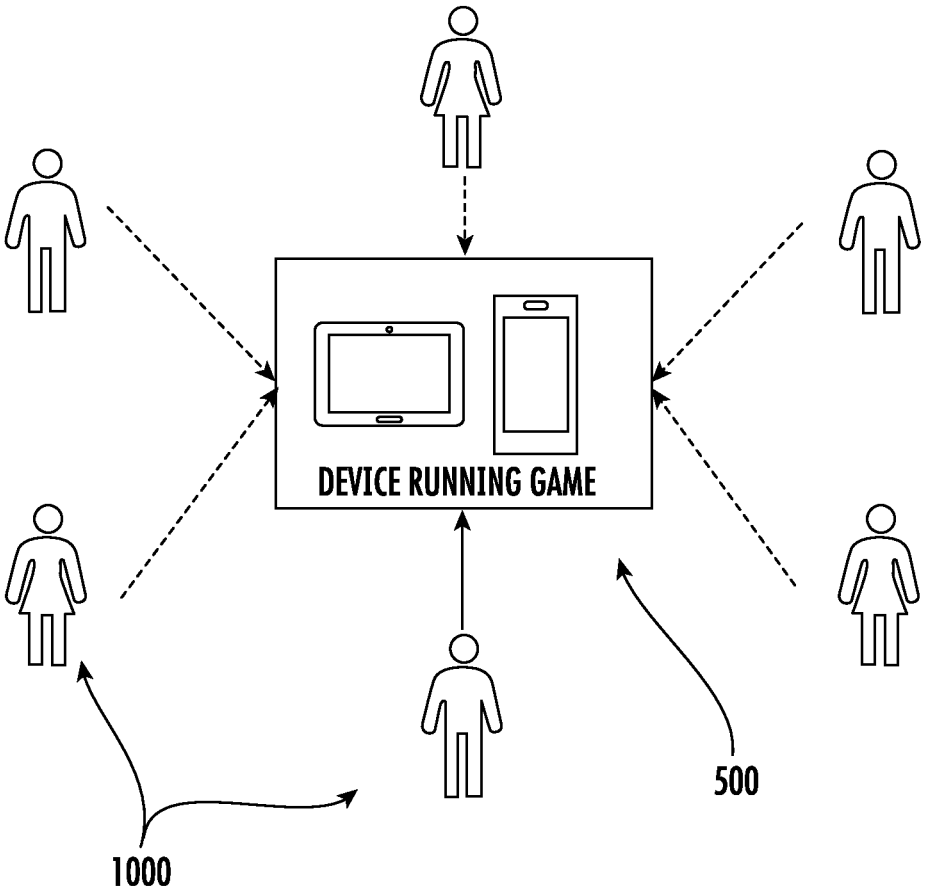
FIG. 4 is a schematic representation of an embodiment of the present disclosure wherein the playing surface is represented on an electronic device.

With reference to FIG. 4, an instance of the game according to the present disclosure may run on a computing device 500, such as but not limited to a laptop, tablet, or smartphone. Players 1000 (only one of which is identified for clarity) interact with the computing device 500 in lieu of a physical embodiment of the game. As players progress through the game session, they manually enter the result of their bowling throws in the computing device 500. The computing device 500 uses the information entered by the players to update the game state in accordance with the rule mechanics described herein.

Figure 5:
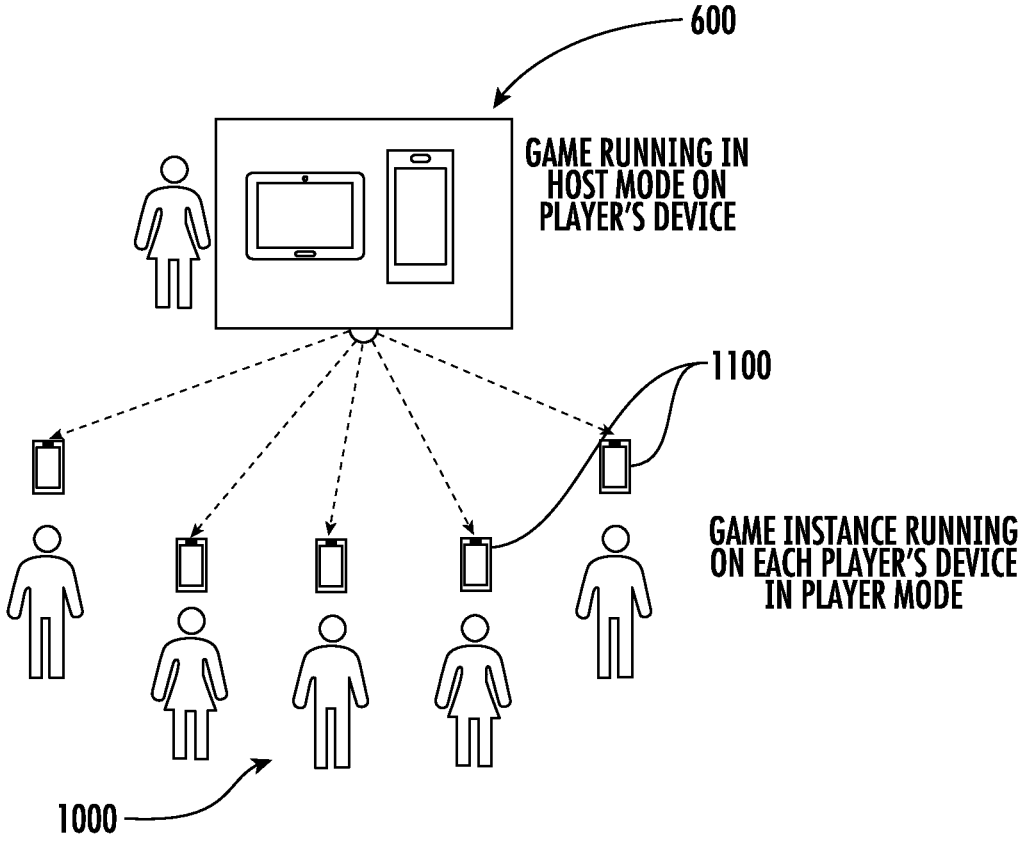
FIG. 5 is a schematic representation of an embodiment of the present disclosure wherein the playing surface is represented on an electronic device, and players connect by way of user devices.

With reference to FIG. 5, another embodiment allows players 1000 to play the game by using a player device 1100, which is any suitable computing device such as but not limited to a laptop, tablet, or smartphone. The player devices 1100 are disposed in communication with a host device 600. As players progress through the game session, they manually enter the result of their bowling throws in their respective player devices 1100. This information is relayed to the host device 600, which uses the information entered by the players to update the game state in accordance with the rule mechanics described herein. The host device 600 relays information about the game state, such as a player's next steps, to the player devices 1100. The communication between the host device 600 and the player devices 1100 may be wired, or may be wireless and utilize a wireless protocol such as, but not limited to NFC, Bluetooth LTE or Zigbee.

Figure 6:
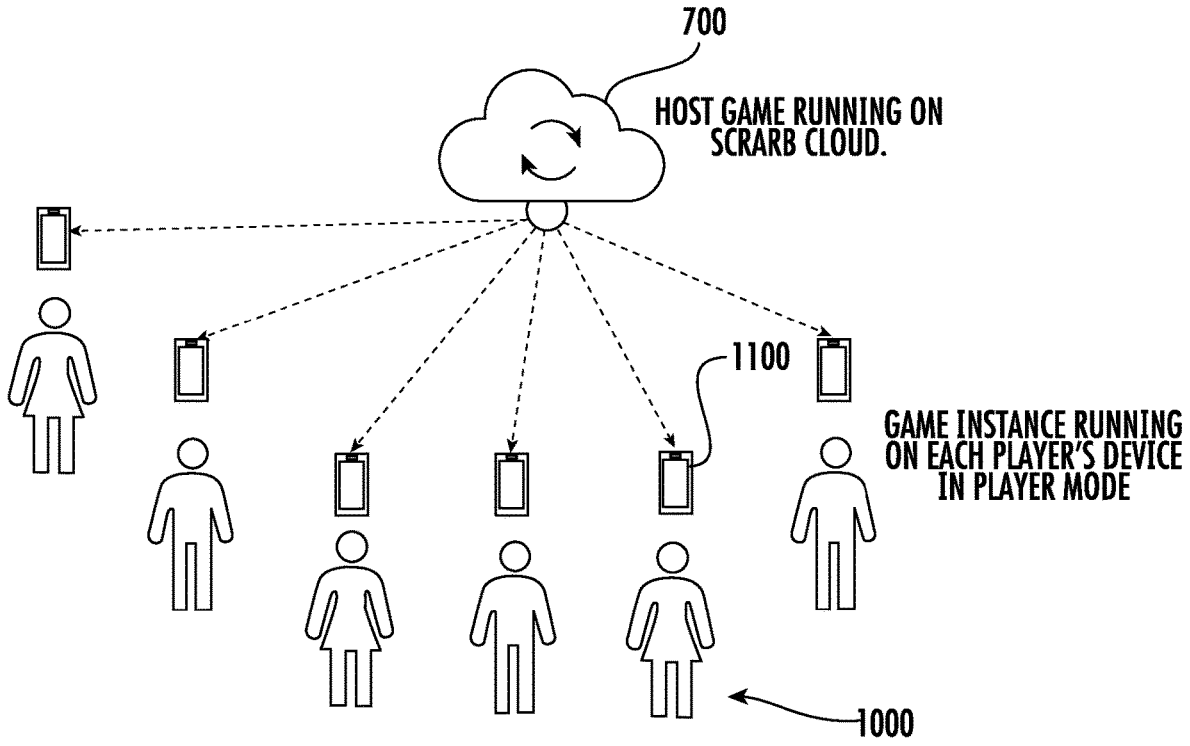
FIG. 6 is a schematic representation of an embodiment of the present disclosure wherein the playing surface is cloud hosted, and players connect by way of user devices.

With reference to FIG. 6, another embodiment allows players 1000 to use player devices 1100 that connect via an internet connection to a server 700, such as but not limited to a cloud server, hosting the instance of the game. As players progress through the game session, they manually enter the result of their bowling throws in their respective player devices 1100. This information is relayed to the server 700, which uses the information entered by the players to update the game state in accordance with the rule mechanics described herein. The server 700 relays information about the game state, such as a player's next steps, to the player devices 11100. A benefit of using a server 700 is that players 1000 may compete despite being physically disparate, such as at different bowling centers. Players 1000 may have user accounts by which they log into the server 700, allowing them to track their performance in past games.

Figure 7:
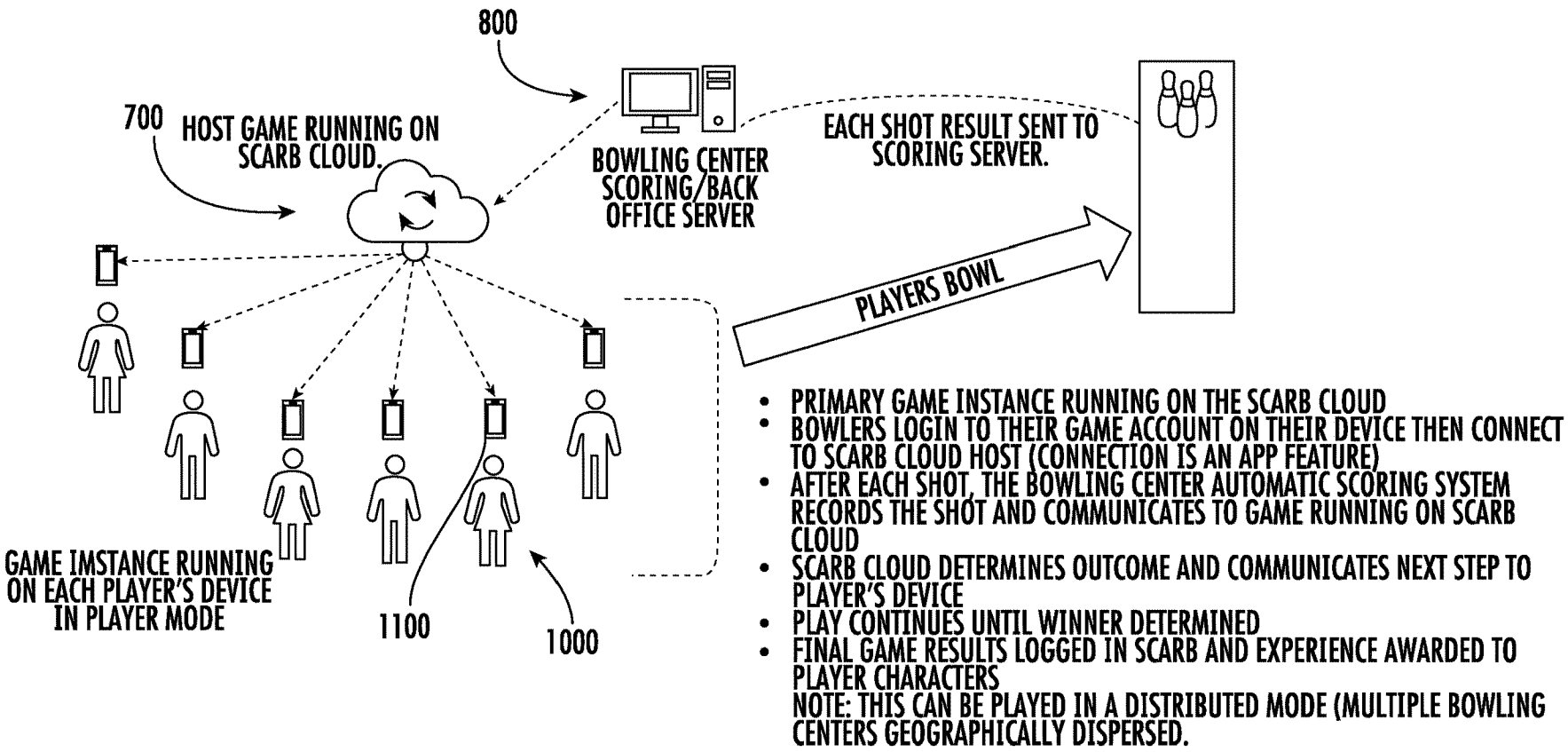
FIG. 7 is a schematic representation of an embodiment of the present disclosure wherein the playing surface is cloud hosted, and the gaming session is integrated with a bowling alley's scoring system.
Figure 8:
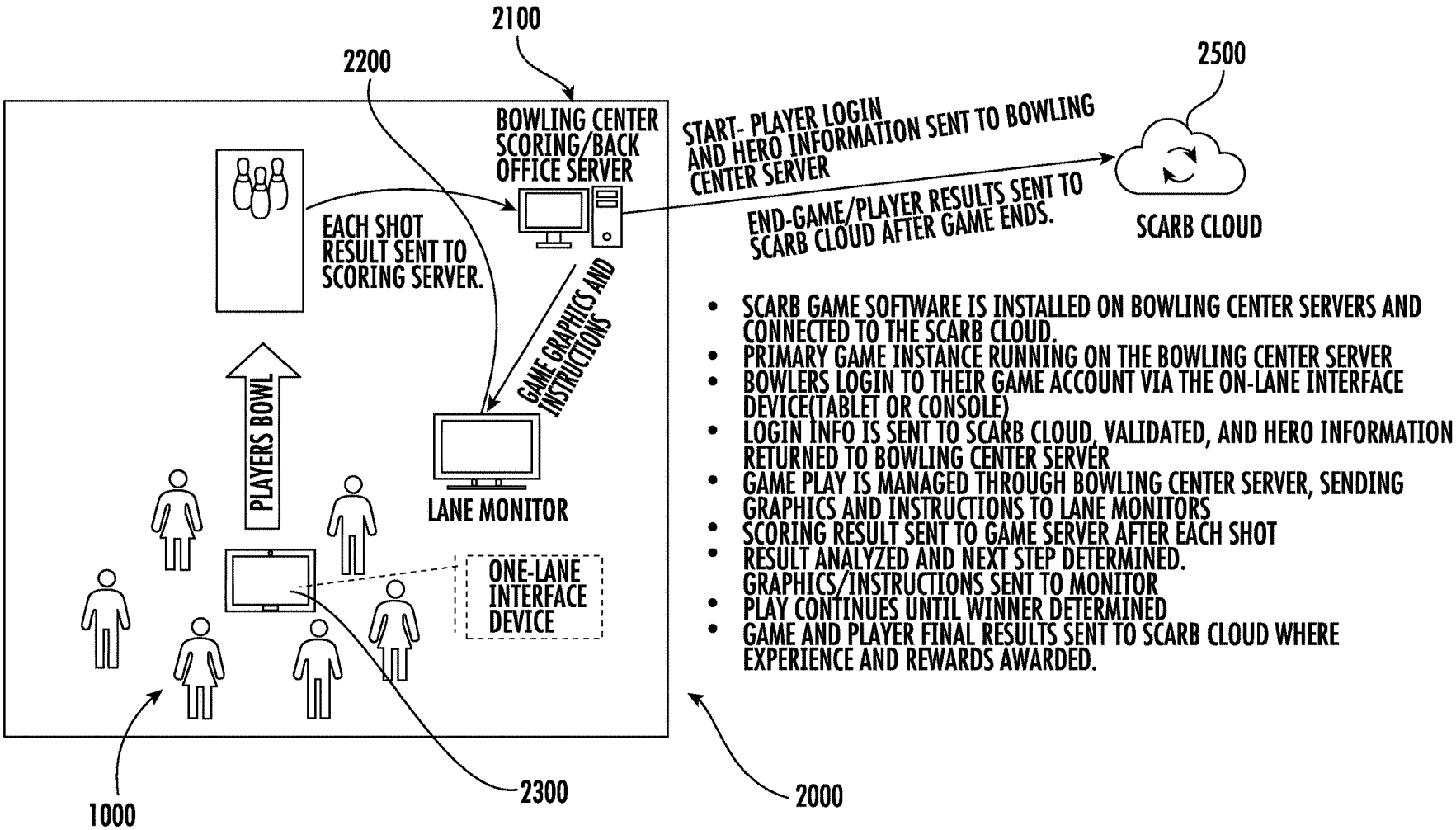
FIG. 8 is a schematic representation of an embodiment of the present disclosure wherein the playing surface is locally hosted, and the gaming session is integrated with a bowling alley's scoring system.

FIGS. 7 and 8 depict alternate embodiments by which a game session is integrated with scorekeeping equipment present in the bowling center, allowing for the automatic entry of players' 1000 bowling throws.

With reference to FIG. 7, when a player 1000 bowls, the result of the throw is determined by the bowling center's server 800, which uses the information to update the game state in accordance with the rule mechanics described herein. The server 800 relays information about the game state, such as a player's next steps, to the player devices 1100. Players 1000 may have user accounts by which they log into the bowling center server 800, allowing them to track their performance in past games. The bowling center server is in communication with the server 700.

With reference to FIG. 8, another embodiment is shown wherein the game according to the present disclosure is integrated with a bowling center's scorekeeping system 2000. Typical bowling center scorekeeping systems 2000 comprise an interface device 2300 disposed adjacent each bowling lane to allow players 1000 to interact with the scorekeeping system 2000. In addition, the scorekeeping systems 2000 include a display 2200 disposed adjacent each bowling lane. The display 2200 and interface device 2300 communicate with the bowling center's server 800. The game instance is hosted on the bowling center's server 2100. To begin a game, each player 1000 uses the interface device 2300 to log into the player's user account. The login information is relayed by the bowling center's server 2100 to a cloud server 2500, which authenticates the login credentials. The bowling center's scorekeeping system 2000 determines the result of a player's 1000 throw and uses the information to update the game state in accordance with the rule mechanics described herein. The display 2200 is used to show players 1000 information relating to the game state, such as a player's next steps.

In at least one embodiment of the present disclosure, a player has an avatar/hero and earns experience from playing the game. This experience carries over from game session to game session and can be used to unlock new unique hero skills, titles, and customization options.

Since many modifications, variations, and changes in detail can be made to the described embodiments of the present disclosure, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the present disclosure should be determined by the appended claims and their legal equivalents.

In addition, the present disclosure has been described with reference to embodiments, it should be noted and understood that various modifications and variations can be crafted by those skilled in the art without departing from the scope and spirit of the present disclosure. Accordingly, the foregoing disclosure should be interpreted as illustrative only and is not to be interpreted in a limiting sense. Further it is intended that any other embodiments of the present disclosure that result from any changes in application or method of use or operation, method of manufacture, shape, size, or materials which are not specified within the detailed written description or illustrations contained herein are considered within the scope of the present disclosure.

Insofar as the description above and the accompanying drawings disclose any additional subject matter that is not within the scope of the claims below, the present disclosure is not dedicated to the public and the right to file one or more applications to claim such additional embodiments is reserved.

Although very narrow claims are presented herein, it should be recognized that the scope of this present disclosure is much broader than presented by the claims. It is intended that broader claims will be submitted in an application that claims the benefit of priority from this application.

While this present disclosure has been described with respect to at least one embodiment, the present disclosure can be further modified within the spirit and scope of this disclosure. This application is therefore intended to cover any variations, uses, or adaptations of the present disclosure using its general principles. Further, this application is intended to cover such departures from the present disclosure as come within known or customary practice in the art to which this present disclosure pertains and which fall within the limits of the appended claims.

Now that the invention has been described,

What is claimed is:

1. A computing device comprising processing circuitry, the processing circuitry being configured to carry out a game played in connection to a player's bowling performance, the processing circuitry being further configured to:

receive information corresponding to the player's bowling performance;

determine an outcome of at least one gameplay instance based on a requirement for the player's bowling performance and the information corresponding to the player's bowling performance;

update a state of the game based on the determination of the outcome;

cause display of information corresponding to the state of the game; and the game comprising:

a playing surface including a start, a finish, and a path extending between the start and the finish;

the path including a plurality of spaces, the at least one gameplay instance associated with at least one of the plurality of spaces; and a plurality of cards each including at least one image indicating the requirement for the player's bowling performance.

2. The computing device of claim 1, wherein the player is assigned a bowling skill level, and the outcome of the gameplay instance corresponds to the player's bowling skill level.

3. The computing device of claim 1, wherein one of a plurality of hero characters is assigned to the player, and the hero character has an associated hero ability that affects the gameplay instance.

4. The computing device of claim 1, further comprising a token placed on the path, the token being moved along the path according to the outcome of the gameplay instance.

5. The computing device of claim 1, the game further comprising at least one die, wherein the requirement is determined at least in part by a result of a roll of the at least one die.

6. The computing device of claim 5, wherein a subset of the plurality of cards are encounter cards, and each encounter card includes an indication of a number of faces of the at least one die.

7. The computing device of claim 1, wherein a subset of the plurality of cards are victory cards, and each victory card includes an indication of a victory requirement, the player's bowling performance meeting the victory requirement resulting in the player winning the game.

8. The computing device of claim 1, wherein the at least one gameplay instance corresponds to a predetermined challenge, and completion of the challenge includes at least one of knocking over a predetermined number of pins, bowling a spare, and bowling a strike.

9. The computing device of claim 1, wherein the at least one gameplay instance corresponds to a predetermined challenge, and completion of the challenge includes knocking over designated bowling pins without knocking over non-designated bowling pins.

10. The computing device of claim 1, wherein the processing circuitry is further configured to:

receive the information corresponding to the player's bowling performance from at least one user device of a plurality of user devices; and cause the plurality of user devices to each display at least some of the information corresponding to the state of the game.

11. The computing device of claim 1, wherein the computing device is comprised in a server, and the processing circuitry is further configured to:

receive the information corresponding to the player's bowling performance from another server; and cause a plurality of user devices to each display at least some of the information corresponding to the state of the game.

12. The computing device of claim 1, wherein the processing circuitry is further configured to:

receive the information corresponding to the player's bowling performance from a scorekeeping system associated with a bowling lane; and cause a lane monitor corresponding to the bowling lane to display at least some of the information corresponding to the state of the game.

13. The computing device of claim 1, wherein the processing circuitry is further configured to:

receive login credentials associated with a user; and cause authentication of the user based on the login credentials.

14. The computing device of claim 1, wherein the processing circuitry is further configured to update a game account associated with the player based on the player's bowling performance, the update to the game account persisting to a future game session.

* * * * *